US005784470A

United States Patent [19]

Fackler et al.

[11] Patent Number: 5,784,470

[45] Date of Patent: Jul. 21, 1998

[54] BATTERY DOOR AND FACEPLATE ARRANGEMENT FOR A COMPLETELY IN THE CANAL HEARING AID DEVICE

[75] Inventors: Ricky L. Fackler, White Bear, Minn.; Lester R. Iburg, Hudson, Wis.; Randolph R. Giller, Sebring, Fla.

[73] Assignee: Resistance Technology, Inc., Arden Hills, Minn.

[21] Appl. No.: 476,857

[22] Filed: Jun. 7, 1995

[51] Int. Cl.[6] ..... H04R 25/00

[52] U.S. Cl. ..... 381/68.6; 381/69

[58] Field of Search ..... 381/68.6, 69.2, 381/68.7, 68, 69; 429/96, 97, 100

[56] References Cited

U.S. PATENT DOCUMENTS

| | | | |
|---|---|---|---|
| 3,062,911 | 11/1962 | Joy | 381/68.5 |
| 4,114,236 | 9/1978 | Vandervort | 16/239 |
| 4,584,437 | 4/1986 | Giannetti | 381/69 |
| 4,598,177 | 7/1986 | McGroarty et al. | 381/69 |
| 4,800,636 | 1/1989 | Topholm | 381/68.6 |
| 5,347,584 | 9/1994 | Narisawa | 381/69.2 |
| 5,357,576 | 10/1994 | Arndt | 381/69 |
| 5,588,064 | 12/1996 | McSwiggen et al. | 381/69 |

FOREIGN PATENT DOCUMENTS

| | | | |
|---|---|---|---|
| 0311233 | 4/1989 | United Kingdom | 381/68.6 |

OTHER PUBLICATIONS

United Hearing Systems, Brochure for The Incomparable C.I.C. Canal-Mate, advertisement, *The Hearing Review*, Worldwide Registry, p. 4, 1994/1995.

Rayovac Corporation advertisement for "The New 5A for CICs," *The Hearing Journal*, Aug. 1995.

*Primary Examiner*—Curtis A. Kuntz
*Assistant Examiner*—Rexford Barnie
*Attorney, Agent, or Firm*—Kinney & Lange, P.A.

[57] ABSTRACT

A hearing aid device is formed of a shell, face and battery door. The face is cut from a faceplate assembly which includes a battery opening and a hinge pin. Opposed ends of the hinge pin are formed integrally with opposed side walls of the battery opening for reduced width. The battery door includes a battery compartment for housing a round battery. An opened end and a closed end of the battery compartment is formed between opposed sides of the battery door and the extent of the battery door is less than 0.130 inches to allow deeper insertion of the hearing aid into an ear canal. Components of the face corresponding to operational components of the hearing aid are arranged to reduce the required face dimension for deeper insertion of the hearing aid.

17 Claims, 7 Drawing Sheets

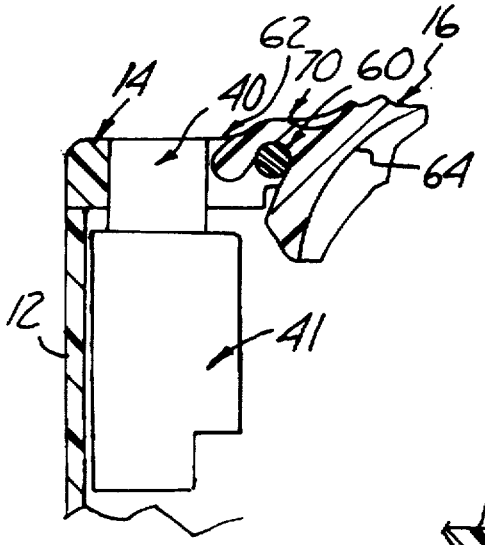
Fig. 3A
Fig. 4
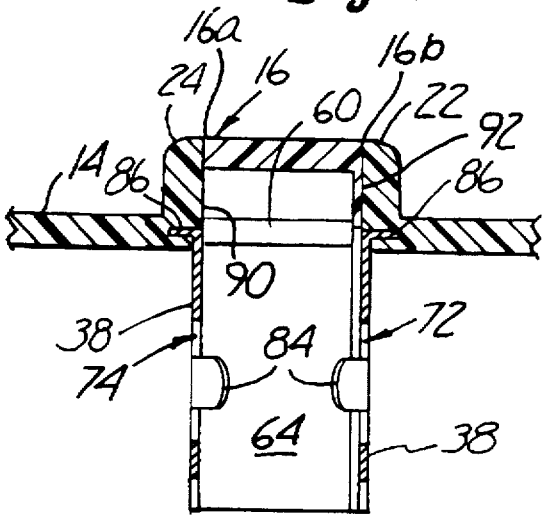
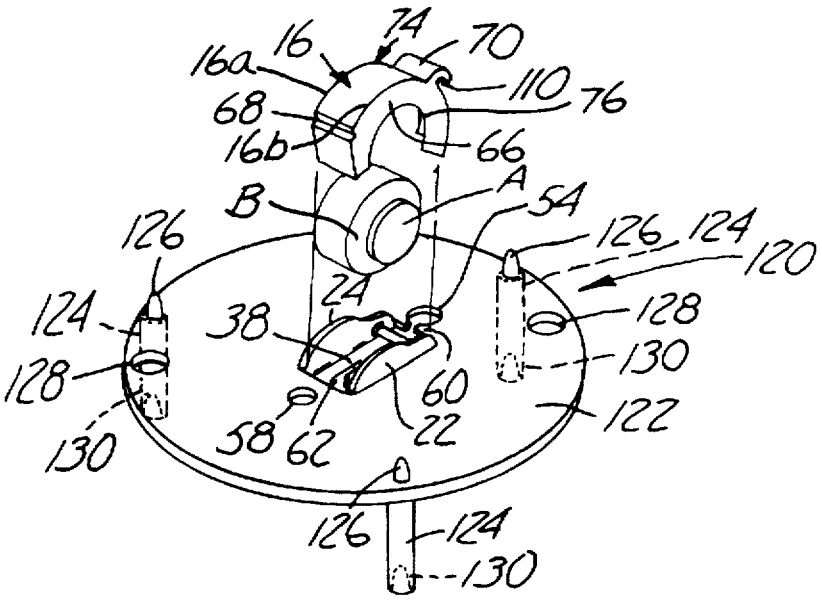
Fig. 7

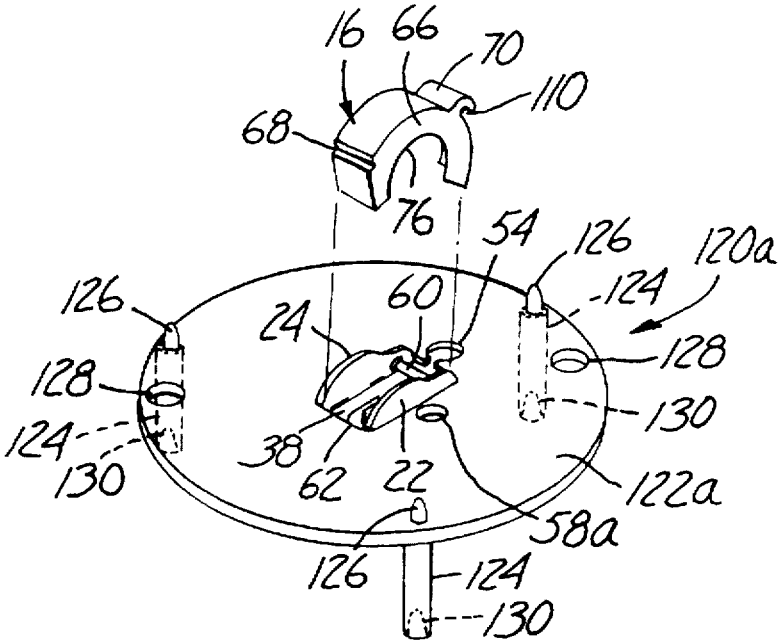
Fig. 8
Fig. 12
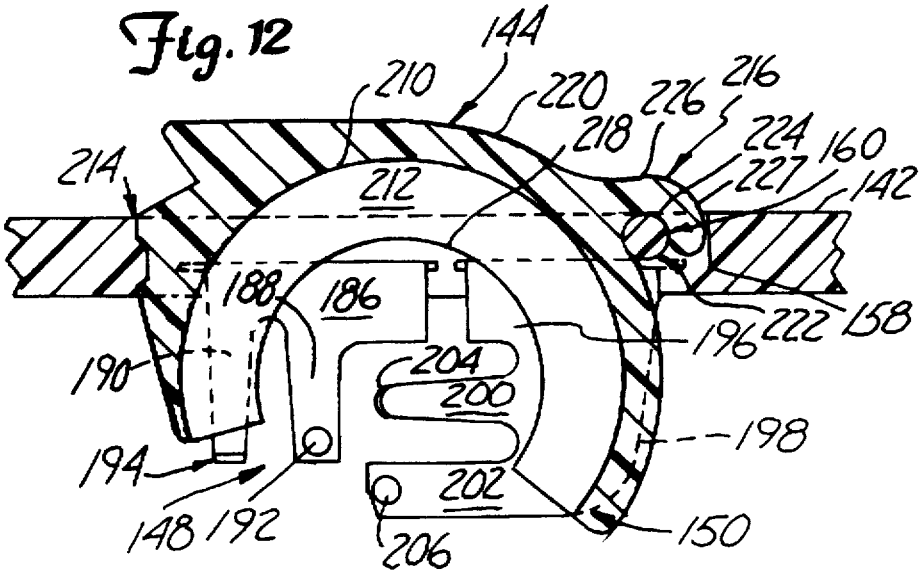

BATTERY DOOR AND FACEPLATE ARRANGEMENT FOR A COMPLETELY IN THE CANAL HEARING AID DEVICE

BACKGROUND OF THE INVENTION

The present invention relates to hearing aids and more particularly relates to a faceplate assembly for a hearing aid.

There has evolved hearing aid instruments which may be inserted completely into the patient's ear canal so that a face of the hearing aid is flush with or below an entrance to the ear canal. These instruments are referred to in the industry as "completely-in-the-canal" ("CIC")". These hearing aid instruments are in contrast to previous hearing aid designs where only a portion of the hearing aid fit within the ear canal and another portion remained outside the ear canal.

Older hearing aid instruments were easily visible when worn by the patient because of their location outside of the ear canal. CIC hearing aid instruments are harder to detect because the face of the hearing aid is flush with or below the entrance to the ear canal. However, known CIC instrument designs are still visible to a careful observer. Thus, it is desirable to further insert the hearing aid into the ear canal so that it is less visible and to reduce the stigma attached to the wearing of such devices.

SUMMARY OF THE INVENTION

The present invention relates to a completely in the canal hearing aid assembly and faceplate therefor which is designed for deeper insertion into the ear canal. A hearing aid includes a face, a battery door and a shell. The face of a hearing aid may be formed from a faceplate having a battery opening. The face of a hearing aid is cut from the faceplate for attachment to a closed end of the shell for housing the operational components of the hearing aid.

The battery door includes a battery compartment and is hingedly connected relative to face. The battery door pivots between an opened position and a closed position to insert or remove a battery from the battery compartment. The battery door is pivotally supported relative the face within the battery opening of the face by a hinge pin. The hinge pin of the present invention is formed integrally with opposed side walls of the battery opening so that opposed ends of the hinge pin are flush with the opposed side walls of the battery opening. The battery compartment is formed within a rigid member of the battery door and has an opened end and a closed end. The width of the battery compartment between the opened end and closed end is less than 0.130 inches. The extent of the battery compartment corresponds to the width of the battery door which is smaller than the width of previous battery doors so that the hearing aid may be inserted further into the ear canal of a patient. Also, components of the face may be positioned to reduce the dimension of the face for deeper insertion of the hearing aid into the ear canal.

BRIEF DESCRIPTION OF THE DRAWINGS

FIG. 3A is a partial sectional view of the hearing aid showing a portion of the battery door, shell and microphone assembly of the hearing aid.

FIG. 4 is a sectional view of the hearing aid taken along line 4—4 of FIG. 3.

FIG. 7 is a perspective view of a faceplate and battery door of a hearing aid of the present invention and a battery for powering the hearing aid.

FIG. 8 is a perspective view of an alternate embodiment of a faceplate of a hearing aid of the present invention.

FIG. 12 is a sectional view of a face and a battery door of an alternative embodiment of the present invention as shown in FIG. 9.

DETAILED DESCRIPTION OF THE PREFERRED EMBODIMENTS

Figure 1:
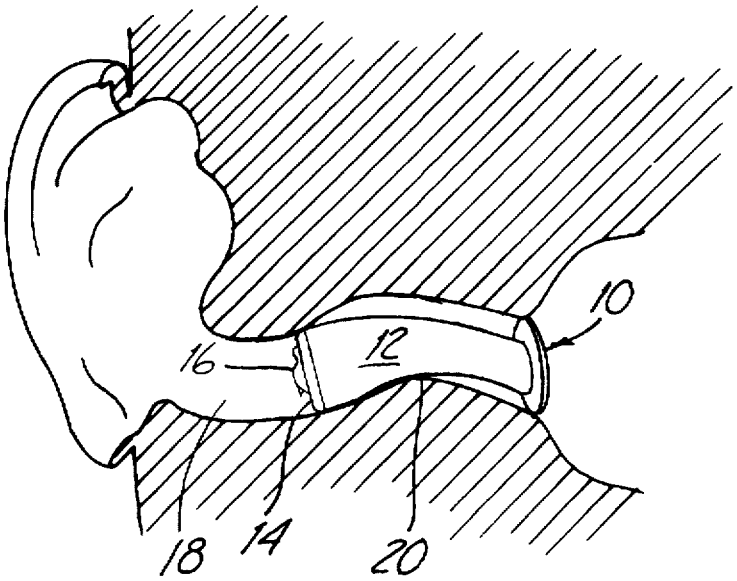
FIG. 1 is an illustrative view of a hearing aid of the present invention inserted into an ear canal of a person.
Figure 1A:
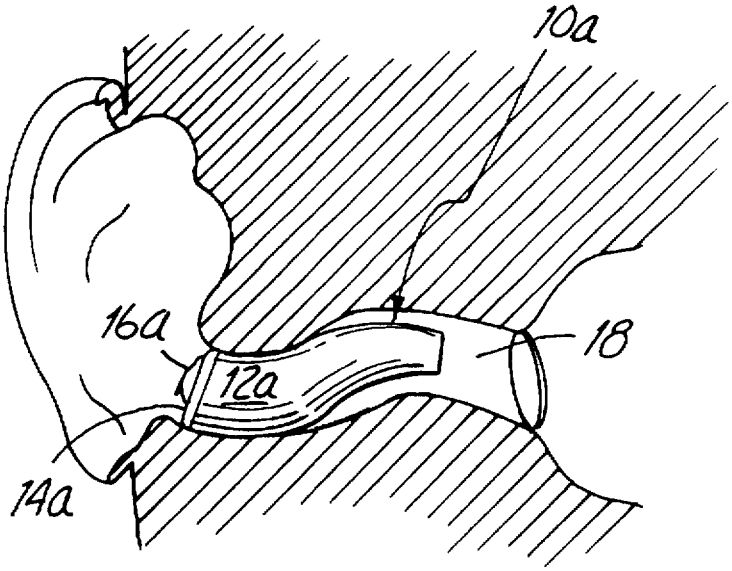
Fig. 1A PRIOR ART
FIG. 1A is an illustrative view of a hearing aid of the prior art inserted into an ear canal of a person.

FIGS. 1 & 1A illustrate CIC hearing aids positioned in an ear canal for operation. FIG. 1 is a hearing aid 10 of the present invention and includes a shell 12, face 14 and battery door 16. The shell 12 encloses the operational components of the hearing aid 10. The face 14 and battery door 16 are positioned at an end of the shell 12. The battery door 16 is pivotally supported relative to the face 14 for insertion of a battery for operation of the hearing aid 10. FIG. 1A illustrates a prior CIC style hearing aid **10*a* which similarly includes a shell 12*a*, face 14*a* and a battery door 16*a***.

As shown comparatively in FIGS. 1 & 1A, the hearing aids 10 or **10*a* are inserted into an ear canal 18 for use. The shell 12*a*, face 14*a* and battery door 16*a* of prior CIC hearing aids 10*a* are sized and shaped for insertion into the ear canal 18 so that the face 14*a* is essentially flush with or below an entrance to the ear canal 18. Contrastingly, in the hearing aid 10 of the present invention, the battery door 16 and face 14 are sized smaller than previous battery doors 16*a* and faces 14*a* are sized so that the hearing aid 10 of the present invention can be inserted into the ear canal 18 to aligned with a second bend 20 of the ear canal 18 so that the face 14 is recessed into the ear canal 18 and the hearing aid 10** is not visible to others when worn.

Figure 2:
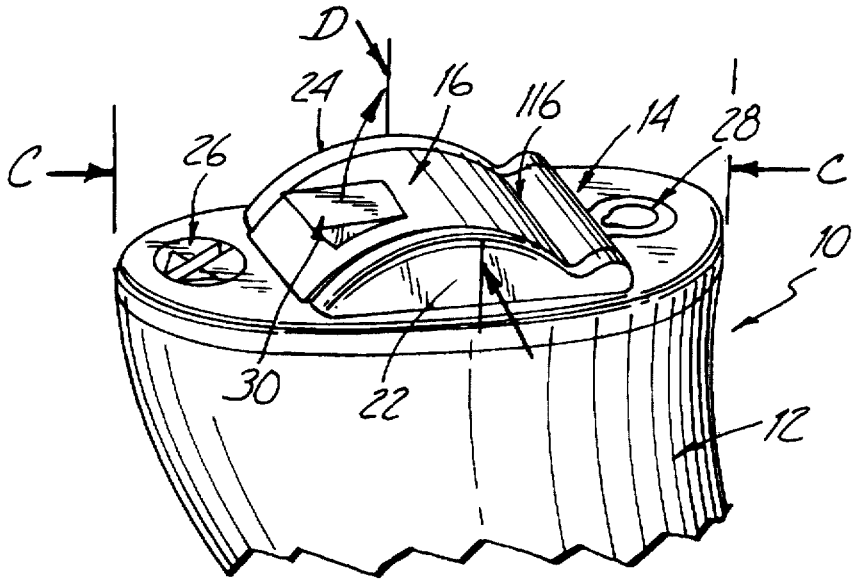
FIG. 2 is a perspective view of a top portion of a hearing aid showing a face, battery door and shell of the hearing aid.

As shown in FIG. 2, the face 14 includes first and second opposed battery walls 22 & 24, set screw 26 for volume control and a microphone tube opening 28. The battery door 16 is hingedly connected relative to the face 14 to pivot between a closed position (shown) and an opened position for inserting a battery for operation of the hearing aid 10. The battery door 16 includes a notched handle 30 to open and close the battery door 16. The first and second opposed battery walls 22 and 24 extend perpendicularly from the face 14 on opposed sides of the battery door 16.

Figure 3:
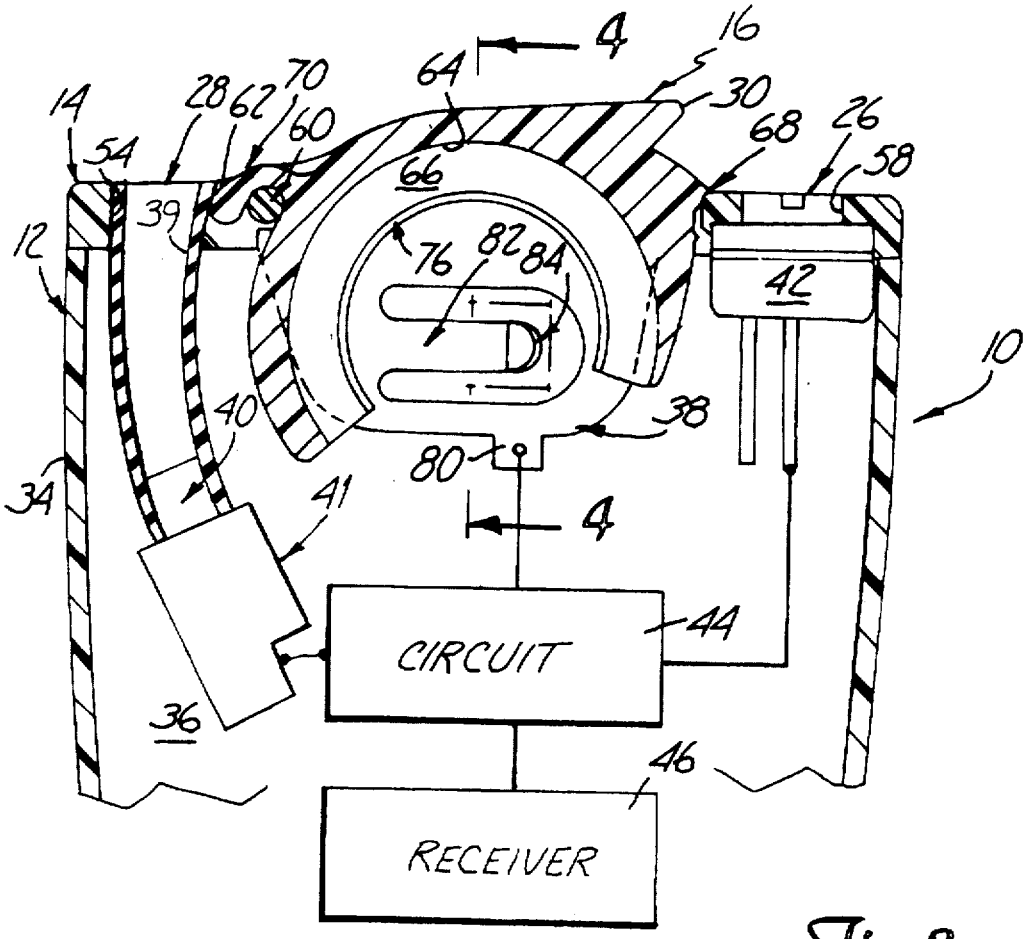
FIG. 3 is a sectional view of the hearing aid taken through the battery door and face of the hearing aid shown in FIG. 2.

As shown in FIG. 3, the shell 12 is formed of an outer wall 34 having an inner cavity 36 for housing the operational components of the hearing aid 10. The face 14 closes an open end of the shell 12. The hearing aid 10 includes opposed battery contacts 38, a microphone connection tube 39, a microphone port 40 and microphone body 41 defining a microphone assembly, a trimmer 42, a hybrid circuit 44 and a receiver 46. The battery contacts 38 are supported by the face 14 and are aligned relative to a battery (not shown) to electrically connected the battery to power the operational components of the hearing aid 10, namely, the microphone assembly (microphone port 40 and microphone body 41), trimmer 42, hybrid circuit 44 and receiver 46.

The face 14 includes a microphone hole 54 therethrough. The microphone connection tube 39 extends through the microphone hole 54 of the face 14 and is secured relative to the microphone hole 54 by a suitable adhesive. An exposed end of the microphone connection tube 39 at face 14 defines the microphone tube opening 28 and an opposed end of the microphone connection tube 39 is connected to the microphone port 40 of the microphone assembly.

The microphone assembly (microphone port 40 and microphone body 41) is supported below the microphone hole 54 within the cavity 36 of the shell 12. Sound is detected at the microphone tube opening 28 and is transmitted through the microphone connection tube 39 to the microphone assembly to convert an audio signal into an electrical signal for amplification. The microphone assembly (microphone port 28 and microphone body 41) may be a Series 4000 type microphone available from Knowles Electronics, Inc. ("Knowles") of Itasca, Ill. Alternatively, as shown in FIG. 3A, a different microphone assembly may be used where the microphone port 40 of the microphone assembly extends through the microphone hole 54 and is supported at face 14 of the hearing aid 10.

The hybrid circuit 44 processes and amplifies the electrical signal received from the microphone 40. The hybrid circuit 44 may be a circuit which is available from Resistance Technology, Inc. ("RTI"), Arden Hills, Minn. 55112 or other commercially available circuit for processing and amplifying an electrical signal from a microphone 40. The set screw 26 extends through a stepped trimmer hole 58 through face 14 (at an upper stepped portion) and is operably connected to the trimmer 42 for controlling and adjusting the amplification of sound for the hearing aid. The trimmer 42 is supported below the set screw 26 in trimmer hole 58 (at a lower stepped portion). The trimmer 42 may be a trimmer available from RTI or other commercially available trimmer.

The amplified electrical signal from the hybrid circuit 44 is further processed or amplified by the trimmer 42 based upon the position of the set screw 26 which is adjusted at the face 14 of the hearing aid 10. The amplified signal is feed to a receiver 46 which converts the amplified electrical signal to an audio signal which is fed into the ear. The receiver 46 may be a Knowles receiver or other commercially available receiver.

The face 14 includes hinge pin 60 and a battery opening 62. The battery door 16 is formed of a rigid member having a battery compartment 64, retainer flange 66, closure lip 68, and hinge bracket 70. The battery door 16 is hingedly connected to the face 14 by cooperation of the hinge pin 60 of face 14 and the hinge bracket 70 of the battery door 16 within the battery opening 62 of the face 14. Closure lip 68 of the battery door 16 is designed to seat against the face 14 when the battery door 16 is closed as shown in FIG. 3. Preferably, the face 14 (and hinge pin 60) is molded of tenite propionate Type No. 307, H Series available from Eastman Kodak, Inc. of Rochester N.Y. The battery walls 22 and 24 are also formed of tenite propionate.

As shown in FIGS. 3 and 4, the rigid member of the battery door 16 is formed of a flexible half ring component having opposed sides **16*a* and 16*b* defining the width of the component. The battery compartment 64 is formed within the half ring component of the rigid member between opposed sides. The half ring component is sized to slightly grip the round extent of a battery inserted into the battery compartment 64. Retainer flange 66 is a flat half ring which extends from side 16*b* of the half ring component of the rigid member to define a closed end 72 of the battery compartment 64. The other side 16*a* of the half ring component defines an opened end 74 of the battery compartment 64 for inserting a battery into the battery compartment 64**. Preferably, the battery door is formed of Nylon 6/6 which is commercially available.

The battery compartment 64 is designed to house a round battery having a flat end and a stepped end. The stepped end of a battery defines a circular raised positive portion and a ring shaped recessed portion. The flat ring of the retainer flange 66 defines an opening 76 (shown in FIG. 3) for the raised positive portion of the stepped end of a battery and the extent of the retainer flange 66 covers the ring shaped recessed portion of the battery at the closed end 72 of the battery compartment 64.

As shown in FIG. 4, the extent or width of the battery compartment 64 between the opened end 74 and the closed end 72 is the same as the extent between opposed sides **16*a* and 16*b* of the rigid member of the battery door 16. The width of the battery compartment 64 (and thus the battery door 16) is preferably sized approximately 0.089 inches to house a battery having a width of approximately 0.082 inches (5 Amp. Battery). This width is smaller than prior battery doors 10*a* which were sized larger than 0.130 inches. Thus the width of the battery door 16 is sized smaller than battery doors 16*a* of prior CIC hearing aids 10*a* to facilitate insertion of the hearing aid 10 further into the ear canal 18**.

Figure 5:
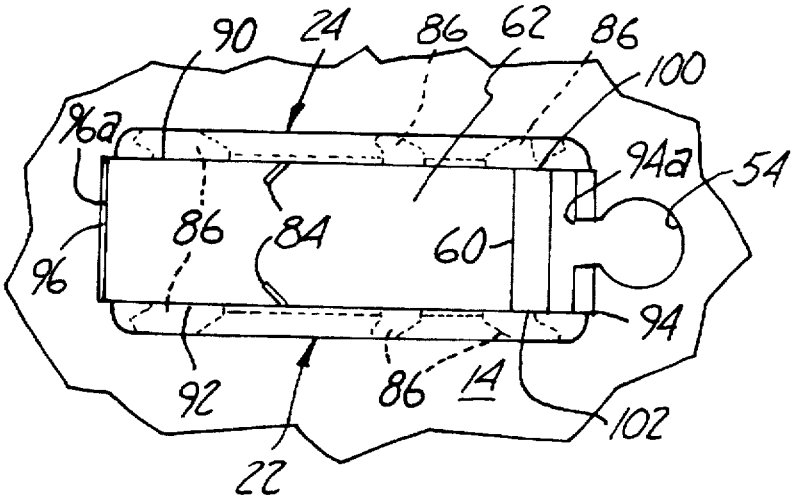
FIG. 5 is a partial top plan view of the face as shown in FIG. 2 with the battery door removed to illustrate a battery opening of the hearing aid of the present invention.

As shown in FIGS. 3–5, opposed battery contacts 38 extend essentially perpendicularly from the face 14 adjacent to the ends 72 and 74 of the battery compartment 64. As shown in FIG. 3, the battery contacts 38 are formed of an oval shaped base having a center opening. The battery contacts 38 include a tab 80, tang 82, lead 84 and anchor 86 (shown in FIGS. 4–5). Tab 80 extends from a lower outer surface of the oval shaped base of the battery contacts 38 to electrically connect the battery contacts 38 to the operational components of the hearing aid 10 to power the hearing aid 10.

Tang 82 is an elongated flexible cantilevered extension which extends from a side of the oval shaped base into the center opening of the oval shaped base. Lead 84 extends at an angle from an exposed end of the tang 82 and is normally positioned to extend into the battery compartment 64 to contact the ends of a battery (not shown) in the battery compartment 64 when the battery door 16 is closed as shown in FIGS. 4–5. The flexible cantilevered tang 82 is designed to slightly flex when contacted to move the lead 84 out of the way to close the battery door 16 with a battery in the battery compartment 64.

FIG. 5 is a top plan view of a section of the face 14 of the hearing aid 10 shown with the battery door 16 removed. As shown, the battery opening 62 of face 14 includes opposed side walls 90 and 92 and opposed end walls 94 and 96. End wall 94 is at a hinge or back end of the battery opening 62 towards the hinge pin 60 and end wall 96 is at a front end opposite the hinge pin 60. As shown, end walls 94 and 96 are chamfered 94*a* and 96*a*. The extent or width between the opposed side walls 90 and 92 is sized similar to the battery door 16 which is supported therein so that a battery supported in the battery compartment 64 of the battery door 16 may be inserted therethrough to close the battery door 16. The battery door 16 is opened to insert a battery into the battery compartment 64. When the battery door 16 is closed, the battery is inserted through the battery opening 62 and is supported in alignment with the leads 84 of the battery contacts 38 inside the shell 12 of the hearing aid 10.

As shown in FIGS. 4–5, the anchors 86 of the battery contacts 38 extend perpendicularly from an upper surface of the oval shaped base. The anchors 86 are secured to the face 14 at opposed side walls 90 and 92 of the battery opening 62. The lead 84 of the contact 38 at side wall 90 contacts the flat end of a battery in the battery compartment 64 of a closed battery door 16 to make a negative connection and the lead 84 of the battery contact 38 at side wall 92 contacts the raised positive portion of said stepped end of the battery supported in the battery compartment 64 of a closed battery door 16. The extent of the anchors 86 is sufficient to secure the battery contacts 38 relative to the face 14, without increasing the width required for the face 14.

Hinge pin 60 includes opposed ends 100 and 102 which extend between opposed sides walls 90 and 92 of the battery opening 62 adjacent to and spaced from end wall 94. As shown in more detail in FIG. 5A, the ends 100 and 102 of the hinge pin 60 are integrally formed with the opposed side walls 90 and 92 of the battery opening 62. Thus, the ends 100 and 102 of the hinge pin 60 are flush with respective opposed side walls 90 and 92 of the battery opening 62.

Figure 5A:
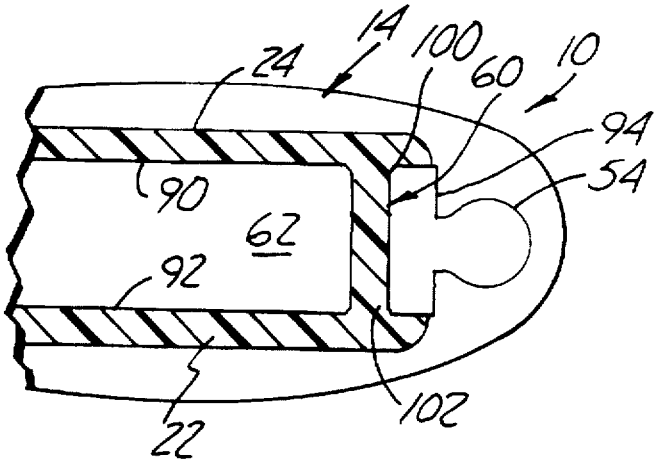
FIG. 5A is a detailed sectional view of a hinge pin and battery walls of the hearing aid of the present invention.
Figure 5B:
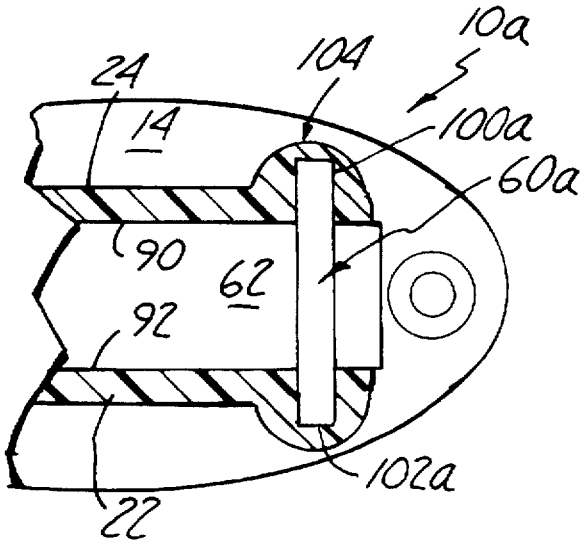
Fig. 5B PRIOR ART
FIG. 5B is a detailed view of a hinge pin and sectional view of battery walls and a mold cavity of a hearing aid of the prior art.

As shown in FIG. 5B, in prior hearing aids 10*a* a separate hinge pin 60*a* was included which was secured relative to the battery opening 62 of the face 14 within a molded cavity 104. The ends 100*a* and 102*a* of the hinge pin 60*a* extend into the molded cavity 104 which extends beyond the side walls 90 and 92 of the battery opening 62 to accommodate and secure the hinge pin 60*a* so that the hinge pin 60*a* will not accidently dislodge from the molded cavity 104. Thus, as shown in FIG. 5B, the extent of the hinge pin 60*a* and molded cavity 104 extend the required width for the face 14 of the hearing aid 10 to accommodate the hinge pin 60*a* and molded cavity 104. Accordingly, the hinge pin 60 of the present invention as shown in FIG. 5A, reduces the width of the face 14 of the hearing aid for facilitating insertion into the ear canal 18 beyond the second bend 20.

Figure 6:
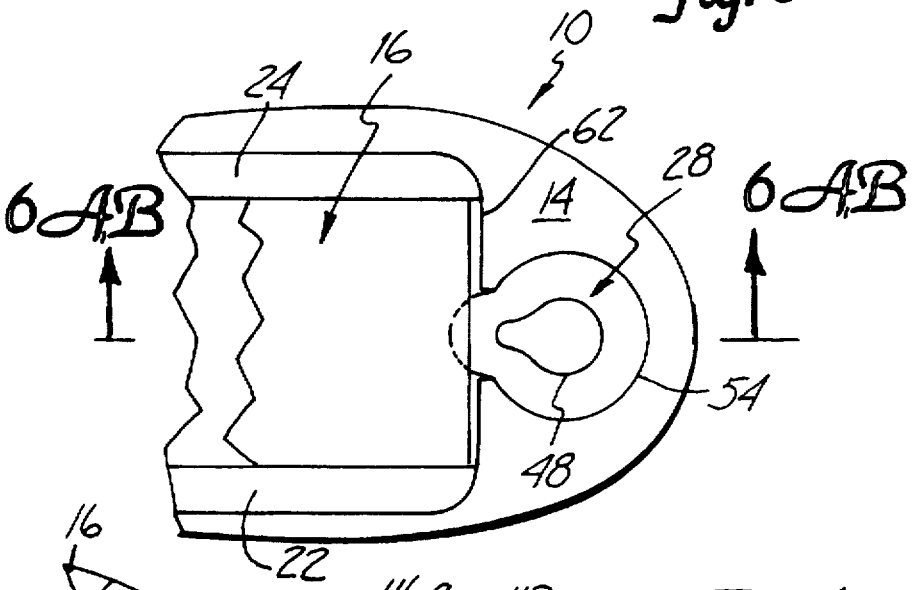
FIG. 6 is a top plan view of the face and battery door shown partially opened of the hearing aid of the present invention.

FIG. 6 is a partial top plan view of the face 14 of the hearing aid 10 shown with the battery door 16 partially opened. As shown in FIGS. 5 and 6, the microphone hole 54 is essentially a circular through hole. As shown, the hole 54 is positioned adjacent to the hinge end of the battery opening 62. The hole 54 is positioned adjacent to the battery opening 62 so that the battery opening 62 is essentially tangential to the hole 54 to define an opened overlap therefor. The position of the hole 54 relative to the battery opening 62 reduces the necessary dimension of the face 14 for deeper insertion of the hearing aid 10 in the ear canal.

Figure 6A:
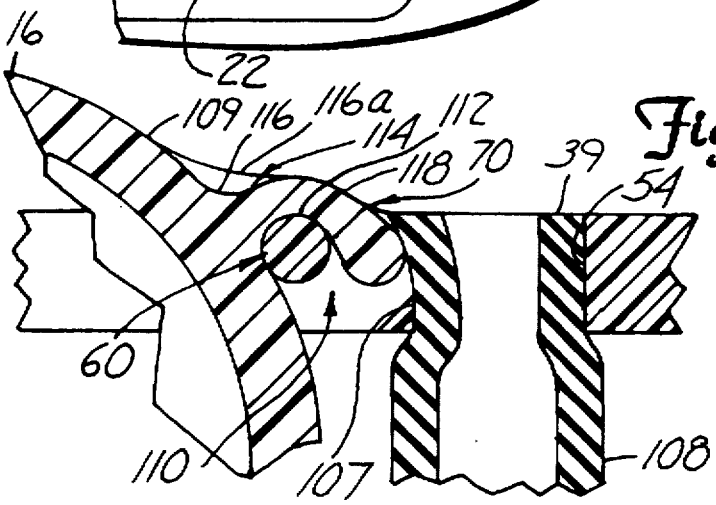
FIG. 6A is a sectional view taken along line 6A—6A of FIG. 6.
Figure 6B:
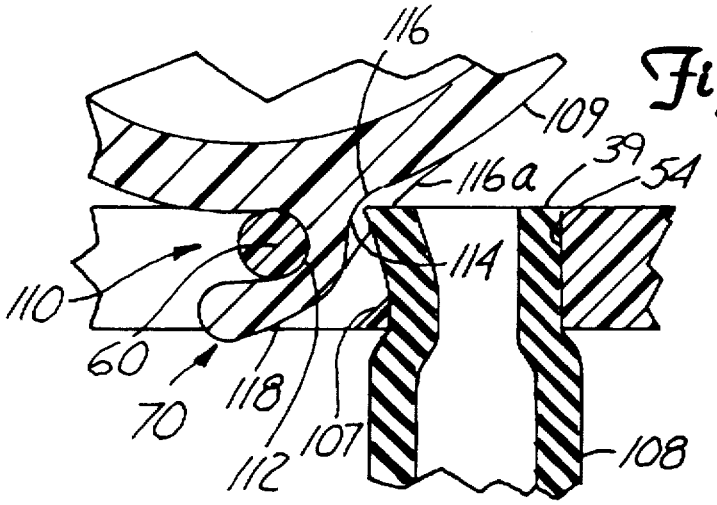
FIG. 6B is a sectional view taken along line 6B—6B of FIG. 6.

As shown in FIGS. 6A & 6B, the microphone connection tube 39 extends through the microphone hole 54 and includes a reduced neck portion 107 and a larger diameter segment 108. The microphone connection tube 39 is manufactured of a plastic extruded tube, such as a silicone tube and is attached to a wall of the hole 54 at the neck portion 107 of the tube 39 by a suitable adhesive. The hinge bracket 70 of the battery door 16 is an elongated J shaped portion which extends from an upper face 109 of the rigid member of the battery door 16. The J shaped portion defines a hinge pin opening 110 and a hinge cavity 112. The J shaped portion is coupled to the upper face 109 of the rigid member at stem 114. The stem 114 is shaped to define a notched upper surface 116 between the upper face 109 of the rigid member and an upper face 118 of the J-shaped portion of the hinge bracket 70 as also shown in FIG. 2. The battery walls 22 and 24 are contoured to the shape of the upper face 109 of the rigid member, the notch 116 and the upper face 118 of the J-shaped portion as shown in FIG. 2.

The hinge bracket 70 of the battery door 16 is coupled to the hinge pin 60 by forcing the hinge pin 60 through the hinge pin opening 110 of the hinge bracket 70 until the hinge pin 60 is positioned in the hinge cavity 112 to pivotally connect the battery door 16 to the face 14. During operation of the battery door 16, the hinge bracket 70 rotates relative to the hinge pin 60 positioned in the hinge cavity 112 to open and close the battery door 16 as comparatively illustrated in FIGS. 6A and 6B. Since the microphone hole 54 is positioned adjacent to the battery opening 62, the battery door 16 rotates very close to the microphone connection tube 39 extending through the microphone hole 54 of the hearing aid 10 of FIG. 3.

The notched upper surface 116 formed between the upper face 109 of the rigid member and the upper face 118 of the J-shaped portion provides clearance between the battery door 16 and the microphone connection tube 39 when the battery door 16 is opened to insert or remove a battery as shown in FIG. 6B. This allows the battery door 16 to rotate to the opened position without interference with the microphone connection tube 39 so that the tube 39 will not accidently dislodge from the microphone hole 54.

As alternatively shown in FIGS. 6A & 6B, if the stem 114 of the hinge bracket 70 was wider, so as to form a slightly curved surface 116*a*, and not the notched surface 116, between the upper face 109 of the rigid member and the upper face 118 of the J-shaped portion, when the battery door 16 was opened, as shown in FIG. 6B, the battery door 16 would interfere with the microphone connection tube 39 causing the tube 39 to become dislodged from the microphone hole 54.

As shown in FIG. 7, the face 14 of the hearing aid 10 is constructed from a faceplate 120. The faceplate 120 of the hearing aid 10 is formed of a circular plate 122 which is dimensioned larger than the face 14 of the hearing aid 10. The circular plate 122 includes the battery opening 62, the battery walls 22 and 24, the hinge pin 60, the battery contacts 38, microphone hole 54 and trimmer hole 58. The battery door 16 snap fits relative to the hinge pin 60 via cooperation of the hinge pin opening 110 of the hinge bracket 70 as shown in FIG. 7. A battery is inserted into the battery compartment 64 through the opened end 74 so that the circular raised portion A extends through opening 76 of the retainer flange 66 and the ring shaped recessed portion B seats against the retainer flange 66 as shown.

The faceplate 120 also includes legs 124, stands 126, and holes 128. Legs 124 extend from a lower surface of the faceplate 120 to support the faceplate 120 in an upright position. As shown, the legs 124 include tapered recesses 130 at a free end of the legs 124. The stands 126 extend from an upper surface of the faceplate 120 and have tapered ends. The tapered ends of the stands 126 of one faceplate 120 fit into the tapered recesses 130 of the legs 124 of an adjacent faceplate 120 for stacking multiple faceplates 120 for storage. During assembly of the hearing aid 10, individual faceplates 120 from a stack of faceplates 120 are cut to form the face 14 of the hearing aid 10. The face 14 is then bonded to the shell 12 after the components of the hearing aid 10 are assembled. Holes 128 control alignment of the faceplate 120 for constructing the face 14 of the hearing aid 10. The faceplate 120 is formed of a tenite propionate as previously described for the face 14.

In this embodiment of the faceplate 120, trimmer hole 58 is a through hole positioned adjacent to and spaced from the front end of the battery opening 62. FIG. 8 illustrates a slightly different arrangement of a faceplate 120*a* of the present invention. Like numbers are used to refer to like parts of the faceplate 120 illustrated in FIG. 7. As shown in FIG. 8, the trimmer hole 58*a* is located adjacent to and spaced from battery wall 22 (and side wall 92 of the battery opening 62) instead of adjacent to and spaced from the front end of the battery opening 62 as shown in FIG. 7. The position of the trimmer hole 58*a* is determined based upon the size and shape of the ear canal 18 (See FIG. 1) that is being fitted with a hearing aid. The size and shape of a person's ear canal will dictate the orientation of the operational components, the shape of the shell 12 and the orientation of the microphone hole 54 and trimmer hole 58 of the face 14 of the hearing aid 10. It is noted that a faceplate 120 does not need to include a microphone hole 54 or a trimmer hole 58. These elements may be added later when the hearing aid 10 is assembled after the optimum location of the operational components is determined based upon measurements of an ear canal 18.

As shown in FIG. 4, preferably, the width of the battery door 16 (between sides 16*a* and 16*b*) is approximately 0.089 inches, which corresponds to the width (between opposed sides 90 and 92) of the battery opening 62. The length (between opposed ends 94 and 96) of the battery opening 62 is approximately 0.291 inches. The diameter of the battery compartment 64 is approximately 0.225. The width of the battery walls 22 and 24 is approximately 0.019 inches as shown in FIG. 5. The extent of the anchor 86 of the battery contacts 38 is approximately 0.019 inches. The diameter of the hinge pin 60 is approximately 0.023 inches and the length of the hinge pin 60 is approximately 0.089 inches. The diameter of the microphone hole 54 is approximately 0.056 inches. The microphone hole 58 centerline is positioned approximately 0.028 inches from the back end of the battery opening 62 to position the hole 58 adjacent to the battery opening 62. As shown in FIG. 2, a preferred length C of the face 14 is approximately 0.496 inches and a preferred width D of the face 14 is approximately 0.161 inches. The length C and width D of the face 14 may be larger for a larger ear canal.

Thus, there has been described a hearing aid of the present invention which has a smaller face 14 for deeper insertion into the ear canal 18 than prior hearing aids. As described, the width of the battery door 16 and width of the battery opening 62 are smaller than previous battery doors and battery openings. The hinge pin 60 is different from previous hinge pin constructions and is formed integrally with the side walls 90 and 92 of the battery opening 62 to reduce the dimension required for the face 14. Further, through holes for access to the operational components of the hearing aid are formed so that the holes are positioned closer to the battery opening to reduce space. The stem 114 of the hinge bracket 70 is shaped to define a notched surface 116 to provide clearance for microphone connection tube 39 of FIG. 3 for opening and closing the battery door 16.

Figure 9:
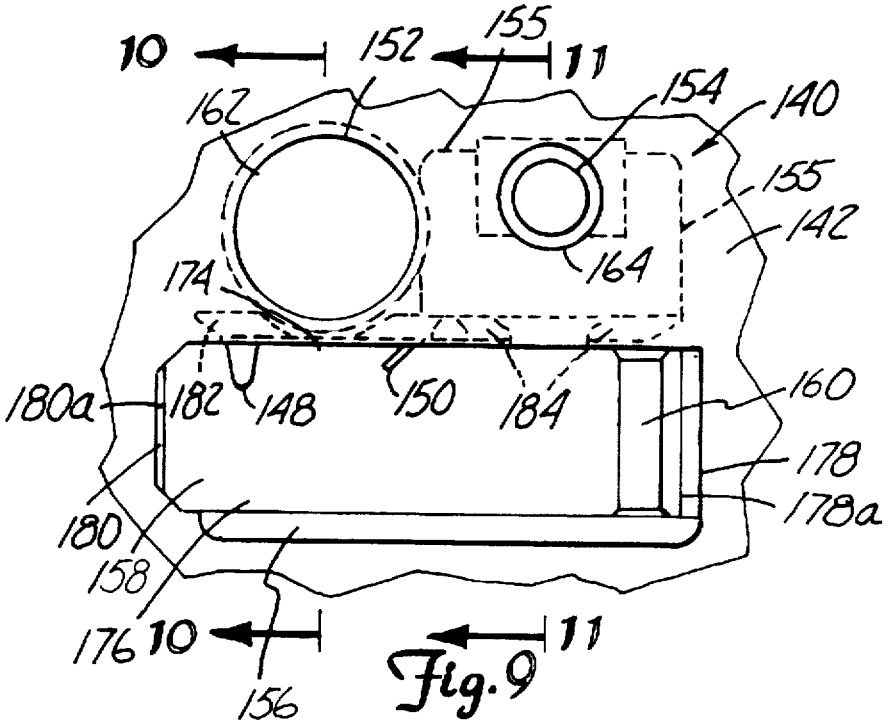
FIG. 9 is a partial top plan view of an alternate embodiment of a hearing aid of the present invention illustrating the battery opening, battery wall, and operational components of the hearing aid.

FIGS. 9–12 illustrate another embodiment of a hearing aid 140 of the present invention. FIG. 9 is a partial top plan view of an alternative hearing aid 140. Hearing aid 140 is similar to hearing aid 10 and includes a face 142, a shell (not shown) and battery door 144 (which is shown in FIG. 12). As shown in FIG. 9, the hearing aid 140 include battery contacts 148 and 150, a trimmer 152, a microphone port 154 and microphone body 155 defining a microphone assembly (shown in phantom) as well as a hybrid circuit and receiver (not shown). The battery contacts 148 and 150 electrically connect a battery to power the operational components (trimmer 152, microphone assembly, hybrid circuit and receiver) of the hearing aid 140. The trimmer 152, microphone assembly, control and receiver operate as previously described for hearing aid 10 of FIGS. 1–6.

The face 142 includes a single battery wall 156, instead of the opposed battery walls 22 and 24 of hearing aid 10 of FIGS. 1–6. The face 142 also includes a battery opening 158, hinge pin 160, trimmer hole 162 and a microphone hole 164. The trimmer 152 is supported so that an upper surface of the trimmer 152 is aligned with the face 142 of the hearing aid 140. A raised set screw (not shown) is operably coupled to the trimmer 152 for controlling the volume of the hearing aid 140. The trimmer hole 162 is chamfered to define a glue channel 166 for securing the trimmer 152 relative to the face 142 of the hearing aid 140.

Figure 11:
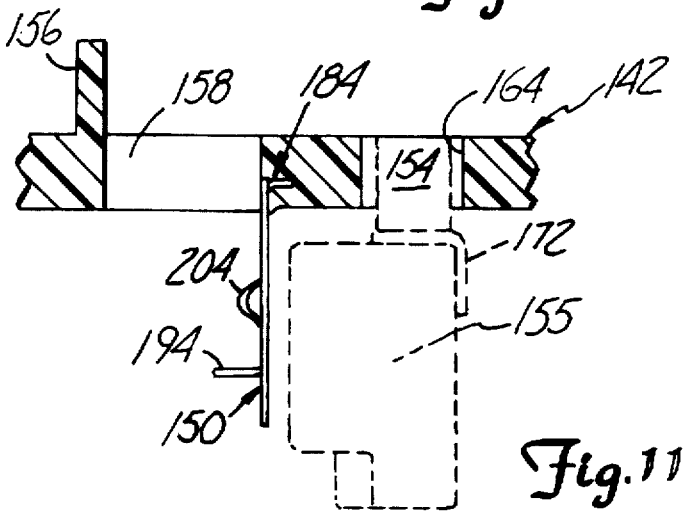
FIG. 11 is a sectional view taken along line 11—11 of FIG. 9.

As shown in FIGS. 9 & 11, the microphone port 154 shown in phantom extends through the microphone hole 164 and is coupled to the microphone body 155 shown in phantom to detect and convert audio signals to electrical signals for amplification. The microphone body 155 is positioned underneath the microphone hole 164. A bracket 172 shown in phantom is positioned between the microphone port 154 and the microphone body 155. Preferably, the microphone assembly is a Series 3000 type microphone available from Knowles.

As shown in FIG. 9, the battery opening 158 includes opposed side walls 174 and 176 and opposed end walls 178 and 180. End wall 178 is at a hinge or back end of the battery opening 158 towards hinge pin 160 and end wall 180 is at a front end opposite the hinge pin 160. As shown, end walls 178 and 180 are chamfered 178*a* and 180*a*. Battery contacts 148 and 150 are supported by the face 142 and both are aligned adjacent to side wall 174 of the battery opening 158 instead of on opposite side walls 90 and 92 of the battery opening 62 as in hearing aid 10 of FIGS. 1–6. The trimmer hole 162 and microphone hole 164 are also both positioned adjacent to side 174 of the battery opening 158 adjacent to the battery contacts 148 and 150.

The single battery wall 156 is located on side 176 of the battery opening 158 opposite of the battery contacts 148 and 150. There is no battery wall at side 174 of battery opening 158 as described in relation to the embodiment of the hearing aid of FIGS. 1–6. The battery contacts 148 and 150 are anchored relative to the face 142 by anchors 182 and 184, respectively.

Figure 10:
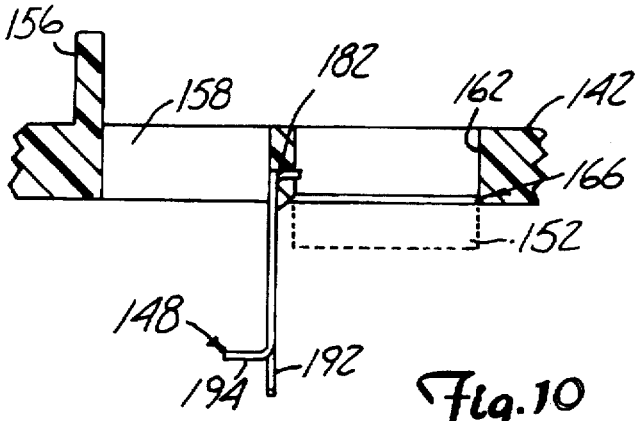
FIG. 10 is a sectional view taken along line 10—10 of FIG. 9.

As shown in FIGS. 9, 10 and 12, the battery contact 148 includes a base 186 and first and second finger extensions 188 and 190. The fingers 188 and 190 extend from the base 186 essentially perpendicular to the face 142. The first finger 188 defines a tab 192 at an exposed end thereof. The second finger 190 includes a lead extension 194 which extends essentially perpendicularly from the second finger 190 so that it is parallel to the face 142 and positioned some distance below the face 142. Anchor 182 extend perpendicularly from the base 186 to secure the contact 148 relative to the face 142.

As shown in FIGS. 9, 11 and 12, battery contact 150 includes an L-shaped base having a support leg 196 and a extending leg 198, and a first finger extension 200 and a second finger extension 202. The anchor 184 extend perpendicularly from the support leg 196 of the base to secure the contact 150 relative to the face 142. The first and second finger extensions 200 and 202 extend from the extending leg 198 of the base essentially parallel to and spaced lower from face 142. The first finger extension 200 includes an angled lead 204 at an extended end thereof and the second finger 202 defines a tab 206 at an exposed end thereof.

The battery door 144 is formed of a rigid member and includes a battery compartment 210, retainer flange 212, closure lip 214 and hinge bracket 216. The rigid member of the battery door 144 is formed of a flexible half ring component having opposed sides defining the width of the component. The retainer flange 212 is a flat half ring which extends from one of said sides of the half ring component of the rigid member to define a closed end of the battery compartment 210. The other side of the half ring component defines an opened end of the battery compartment 210 for inserting a battery into the battery compartment 210.

The battery compartment 210 and battery door 144 are similar to the battery door 16 and battery compartment 64 of hearing aid 10 of FIGS. 1–6. The battery compartment 210 is designed to house a round battery having a flat end and a stepped end having a circular raised positive portion and a ring shaped recessed portion. The flat half ring of the retainer flange 212 defines an opening 218 for the raised portion of the stepped end of a battery and the extent of the retainer flange 212 covers the ring shaped recessed portion of a battery. Preferably, the extent or width of the battery compartment 210 is approximately 0.089 inches to house a battery having a width of approximately 0.082 inches (5 Amp. Battery). This width is smaller than prior battery doors 10*a* which were sized larger than 0.130 inches. Thus the width of the battery door 144 is sized smaller than battery doors 16*a* of prior CIC hearing aids 10*a* to allow the hearing aid 140 to be inserted further into the ear canal 18.

The hinge bracket 216 is a J-shaped portion, similar to hinge bracket 70, which extends from an upper face 220 of the rigid member of the battery door 144. The J-shaped portion defines a hinge pin opening 222 and a hinge cavity 224. The J-shaped portion is coupled to the upper face 220 of the rigid member at stem 226. The stem 226 may be shaped to define a curved surface between the upper face 220 of the rigid member and an upper face 277 of the J-shaped portion, and not a notched upper surface 116 as formed between the upper face 109 of the rigid member and the upper face 118 of the J-shaped portion of the hearing aid 10 of FIGS. 1–6.

The battery door 144 is pivotally connected relative to face 142 within the battery opening 158 via cooperation of the hinge pin 160 and the hinge bracket 216. To pivotally connect the hinge bracket 216 relative to the hinge pin 160, the hinge pin 160 is forced through the hinge pin opening 222 of the hinge bracket 216 to position the hinge pin 160 in the hinge cavity 224 so that the hinge bracket 216 rotates relative to the hinge pin 160 to open and close the battery door 144.

The tabs 192 and 206 of battery contacts 148 and 150, respectively connect the battery contacts 148 and 150 to the operational components of the hearing aid 140 similar to tabs 80 of battery contacts 38. As shown in FIGS. 9, 10 & 12, the lead extension 194 of battery contact 148 is supported by finger extension 190 extending perpendicularly from the face 142 at side wall 174 proximate to the front end of the battery opening 158. The lead extension 194 extends perpendicularly from a free end of the finger extension 190 into the battery opening 158. The length of the finger extension 190 is sufficient and the length of the lead extension 194 is sufficient so that the lead extension 194 contacts a lower extent of the ring shaped recessed portion (a portion not covered by the retainer flange 212) of a battery in the battery compartment 210 of a closed battery door 144 for a negative battery connection.

As shown in FIGS. 9, 11 & 12, the extending leg 198 of the base of battery contact 150 extends perpendicularly from side wall 174 at the hinge end of the battery opening 158. The finger extension 200 of battery contact 150 extends perpendicularly from the extending leg 198 so that the extended end of the finger extension 200 is positioned towards a center portion of the battery opening 158. The angled lead 204 extends at an angle from the extended end of the finger extension 200 into the battery opening 158. The finger 200 is positioned so that the angled lead 204 is positioned to contact the raised portion of the stepped end of a battery in the battery compartment 210 of a closed battery door 144 for a positive battery connection The finger extension 190 supporting the lead extension 194 and the finger extension 200 supporting the angled lead 204 are designed to slightly flex when contacted so that the battery door 144 may be closed with a battery in the battery compartment 210 to align the lead extension 194 and angled lead 204 with the ring shaped recessed portion and raised portion, respectively, of the stepped end of a battery.

The inclusion of only a single battery wall 156, the reduced width of the battery door 144 and the placement of the battery contacts 148 and 150 along a single side 174 of the battery opening 158 is designed to allow the hearing aid 140 to be inserted deeper into the ear canal 18 as shown in FIG. 1. The face 142 of hearing aid 140 of FIGS. 9–12 may also be assembled from a faceplate which may include the battery opening 158, hinge pin 160, battery contacts 148 and 150 and trimmer and microphone holes 162 and 164.

The face 142 and battery door 144 of FIGS. 9–12 are formed of the same materials as that described for the face 14 and battery door 16 of FIGS. 1–6. Similarly, the size and dimensions of the face 142, battery door 144, battery wall 156, battery opening 158, hinge pin 160, anchor 182 and 184 of battery contacts 148 and 150, respectively, and battery compartment 210 are similar to that described for the corresponding elements of FIGS. 1–6. The trimmer hole 162 is approximately 0.100 inches in diameter and is positioned approximately 0.010 inches from the battery opening 158 at a closest position. Since there is no battery wall at side 174 of the battery opening 158, the trimmer hole 162 may be positioned closer to the battery opening 158, than it could be positioned if a battery wall was included at side 174 as in hearing aid 10 of FIGS. 1–6.

As described in relation to the embodiment of hearing aid 10 of FIGS. 1–6, the width of the battery door 144 and width of the battery opening 158 are smaller than previous battery doors and battery openings. The hinge pin 160 is different from previous hinge pin constructions and is formed integrally with the side walls 174 and 176 of the battery opening 158 for reduced length. In the embodiment described, the trimmer hole 162 and microphone hole 164 are positioned on one side 174 of the battery opening 158. Since a battery wall is not included at the side 174, the component holes may be positioned closer to the battery opening 158 adjacent to the battery contacts 148 and 150, to reduce the required width for the face 142 of the hearing aid 140. The contacts 148 and 150 and trimmer 152 and microphone assembly are both positioned at side 174 for optimum placement of the hearing aid components for fitting a particular shaped ear canal.

Although the present invention has been described with reference to preferred embodiments, workers skilled in the art will recognize that changes may be made in form and detail without departing from the spirit and scope of the invention. It is noted that the FIGS. are not drawn to scale and certain features may have been exaggerated for clarity.

What is claimed is:

1. A hearing aid faceplate for use in assembly of a hearing aid, the hearing aid faceplate comprising:

a plate including an elongated battery opening having opposed side walls and opposed end walls, wherein the plate includes a hole positioned adjacent to the battery opening where the battery opening is essentially tangential to the hole; and a hinge pin extending between opposed side walls of the battery opening adjacent to and slightly spaced from one of said ends, said hinge pin having opposed ends formed integrally with said side walls of said battery opening, the ends of the hinge pin being flush with the battery opening side walls.

2. The faceplate of claim 1 wherein the hinge pin is formed of a polymer material.

3. The faceplate of claim 1 wherein the width of the battery opening between said opposed side walls is less than 0.130 inches.

4. The faceplate of claim 1 wherein an opened extent is formed between the hole and the battery opening to define an opened overlap therebetween.

5. The faceplate of claim 1 wherein the plate includes a plurality of legs extending from a lower surface of the plate, said legs having a recess at a free end of the leg, and a plurality of stands corresponding to said legs and extending from an upper surface of the plate, the stands dimensioned for insertion into the recess of a corresponding leg of another plate for stacking adjacent faceplates.

6. The faceplate of claim 1 wherein the plate includes only one battery wall extending from an upper surface of the plate adjacent to one of said battery opening side walls.

7. The faceplate of claim 1 wherein a battery contact for a positive connection and a battery contact for a negative connection extend from one of said side walls of the battery opening for connecting to positive and negative terminals of a battery.

8. The faceplate of claim 7 wherein the battery contact for the positive connection is aligned to contact a raised portion of a stepped end of a battery and the battery contact for the negative connection is aligned to contact a recessed portion of the stepped end of a battery.

9. A battery door and faceplate combination for a hearing aid assembly, the battery door and faceplate combination comprising:

a faceplate including:

a plate having an elongated battery opening having opposed side walls and opposed end walls, wherein the faceplate includes a through hole positioned adjacent to the battery opening where the battery opening is essentially tangential to the hole;

a hinge pin extending between opposed side walls of the battery opening adjacent to and slightly spaced from one of said ends, said hinge pin having opposed ends formed integrally with said side walls of said battery opening, the ends of the hinge pin being flush with the battery opening side walls; and a battery door having opposed first and second sides and a battery compartment for supporting a battery, the battery door having a hinge bracket for pivotally connecting the battery door relative to the faceplate to rotate between an opened position and a closed position, the hinge bracket having an elongated hinge cavity which is sized relative to the hinge pin to allow the hinge bracket to rotate relative to the hinge pin extending through the hinge cavity.

10. The combination of claim 9 wherein the width of the battery door between opposed sides is less than 0.130 inches.

11. The combination of claim 9 wherein an opened extent is formed between the hole and the battery opening to define an opened overlap therebetween.

12. The combination of claim 9 wherein the hole includes a microphone tube extending therethrough.

13. The combination of claim 12 wherein the battery door is formed of a curvedly shaped rigid member having a curved upper face and the hinge bracket is attached to the curved upper face of the rigid member by a stem, the stem being shaped to define a notch between the upper face of the rigid member and an upper face of the hinge bracket for providing clearance between the battery door in the opened position and the microphone tube extending through the hole.

14. The combination of claim 13 wherein the hinge bracket is formed of a J-shaped portion.

15. A completely in the ear hearing aid comprising:

means for detecting sound and converting said detected sound into electrical signal;

means for amplifying the electrical signal;

means for converting the amplified electrical signal to an audio signal for detection by the user, said means for detecting, amplifying, converting and defining the operational components of the hearing aid;

a shell being shaped and sized for insertion into an ear canal for housing the operational components of the hearing aid, said shell having an opened end;

a face for closing an opened end of the shell, said face having a battery opening and a hinge pin, the battery opening having opposed side walls and opposed end walls wherein the face includes a through hole positioned adjacent to the battery opening where the battery opening is essentially tangential to the hole and the hinge pin extending between opposed side walls of the battery opening adjacent to and slightly spaced from one of said ends, said hinge pin having opposed ends formed integrally with said side walls of said battery opening, the ends of the hinge pin being flush with respective battery opening side walls; and a battery door having a battery compartment for supporting a battery for powering the hearing aid, said battery door including a hinge bracket for pivotally connecting the battery door relative to the face; and battery contacts positioned to electrically connect a battery supported in the battery compartment of the battery door and the operational components of the hearing aid for powering the hearing aid, wherein the face is recessed in the ear canal when the hearing aid is worn so that the hearing aid is not visible to others.

16. The hearing aid of claim 15 wherein the battery door is formed of a rigid member having opposed first and second sides and the battery compartment is formed within the rigid member and includes an opened end and a closed end, the opened end and the closed end of the battery compartment being aligned with the opposed sides of the rigid member and the extent between the sides of the rigid member defining the width of the battery door, said width being less than 0.130 inches.

17. The hearing aid of claim 15 wherein an opened extent is formed between the hole and the battery opening to define an opened overlap therebetween.

* * * * *